US010149553B1

(12) United States Patent
Carbone

(10) Patent No.: US 10,149,553 B1
(45) Date of Patent: Dec. 11, 2018

(54) SUPPLEMENTAL SUPPORT FOR INFANT CARRIER HANDLE

(71) Applicant: Nicholas D. Carbone, Aurora, CO (US)

(72) Inventor: Nicholas D. Carbone, Aurora, CO (US)

( * ) Notice: Subject to any disclaimer, the term of this patent is extended or adjusted under 35 U.S.C. 154(b) by 0 days.

(21) Appl. No.: 15/883,059

(22) Filed: Jan. 29, 2018

(51) Int. Cl.

| | |
|---|---|
| ***B25G 3/20*** | (2006.01) |
| ***A47D 15/00*** | (2006.01) |
| ***B25G 3/24*** | (2006.01) |
| *A47D 13/02* | (2006.01) |

(52) U.S. Cl.
CPC ..... *A47D 15/00* (2013.01); *B25G 3/20* (2013.01); *B25G 3/24* (2013.01); *A47D 13/02* (2013.01); *Y10T 24/4016* (2015.01)

(58) Field of Classification Search
CPC ..... Y10T 24/4016; Y10T 24/4077; Y10T 24/3944; A47D 15/00; A47D 15/006; B25G 3/20; B25G 3/24
USPC ..... 16/901, DIG. 25, 422, 425, 426
See application file for complete search history.

(56) References Cited

U.S. PATENT DOCUMENTS 5,983,458 A * 11/1999 Jackson ..... A45F 5/02 24/170
7,712,191 B2 * 5/2010 Huang ..... A44B 11/065 24/170
8,851,342 B2 * 10/2014 Carbone ..... A47D 13/02 224/158
9,021,663 B2 * 5/2015 Maudsley ..... A45F 5/10 16/430
9,038,245 B2 * 5/2015 Owens ..... A45F 5/10 16/430
2007/0193001 A1 * 8/2007 Huang ..... A44B 11/065 24/71 ST
2008/0141507 A1 * 6/2008 Huang ..... A44B 11/065 24/71 ST
2012/0175920 A1 * 7/2012 Carbone ..... A47D 13/02 297/183.1
2014/0259535 A1 * 9/2014 Owens ..... A45F 5/10 16/430
2014/0259536 A1 * 9/2014 Maudsley ..... A45F 5/10 16/430
2015/0223591 A1 * 8/2015 Owens ..... A45F 5/10 16/430

* cited by examiner

*Primary Examiner* — Emily M Morgan

(57) ABSTRACT

A supplemental support for infant carrier handle has top and bottom clamshells and a retention strap assembly. An upper arm support and a safety lanyard assembly can also be incorporated. In order to install the supplemental support on an infant carrier handle, the retention strap is initially tightened over the handle. Once the retention strap is initially snug, the user can push the bottom clamshell upwards towards the top clamshell, hinging the supplemental support into a closed configuration. Because of the unique function of the clamshell hinge, the hinging action tightens the retention strap even further upon closing. The bottom and top clamshells can then lock together. The supplemental support for infant carrier handle is thereby securely locked onto the infant carrier's handle and the user can simply place the bottom clamshell on his or her forearm and proceed to securely and comfortably carry the infant carrier.

20 Claims, 16 Drawing Sheets

100

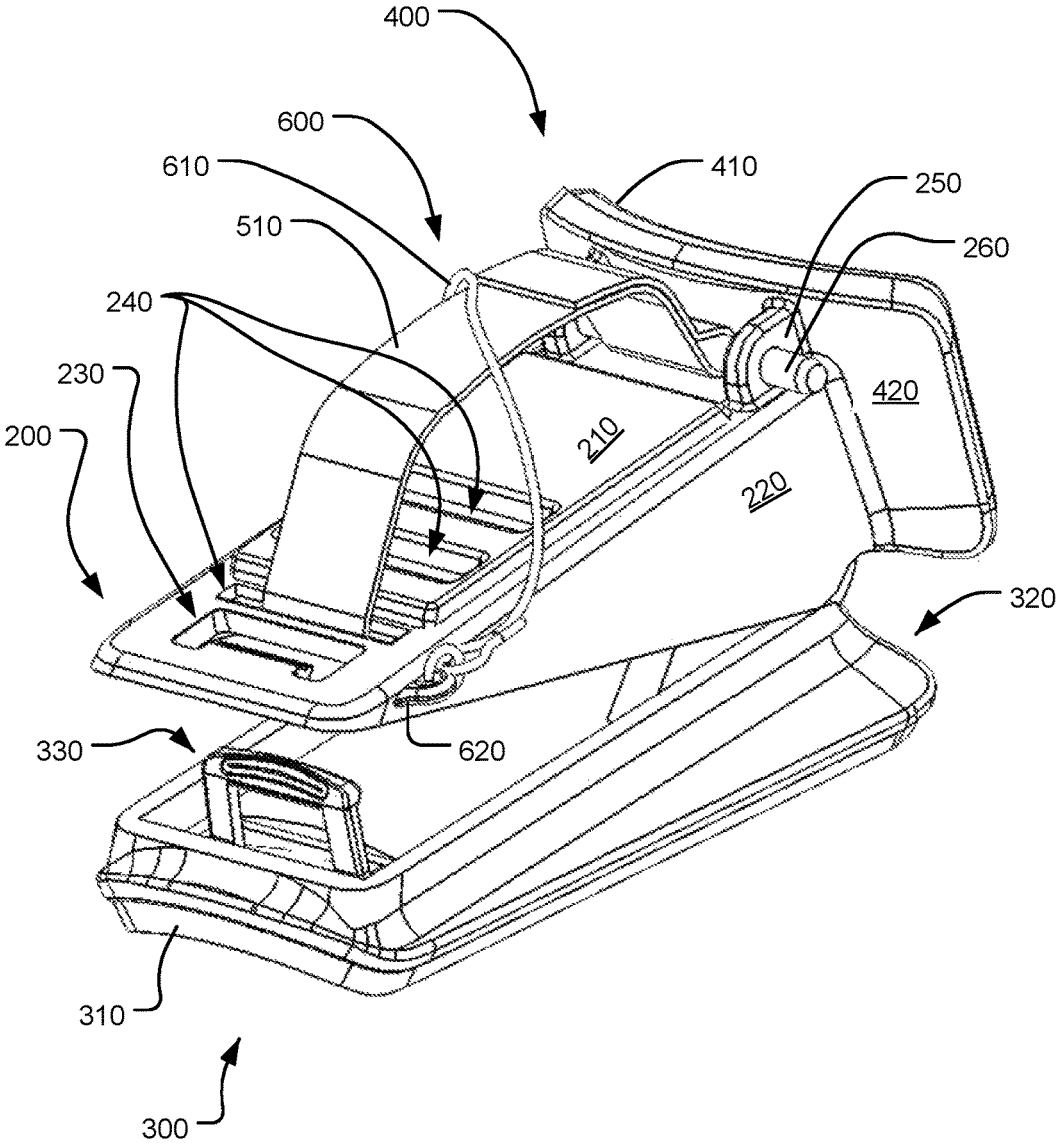
FIG. 2
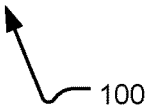

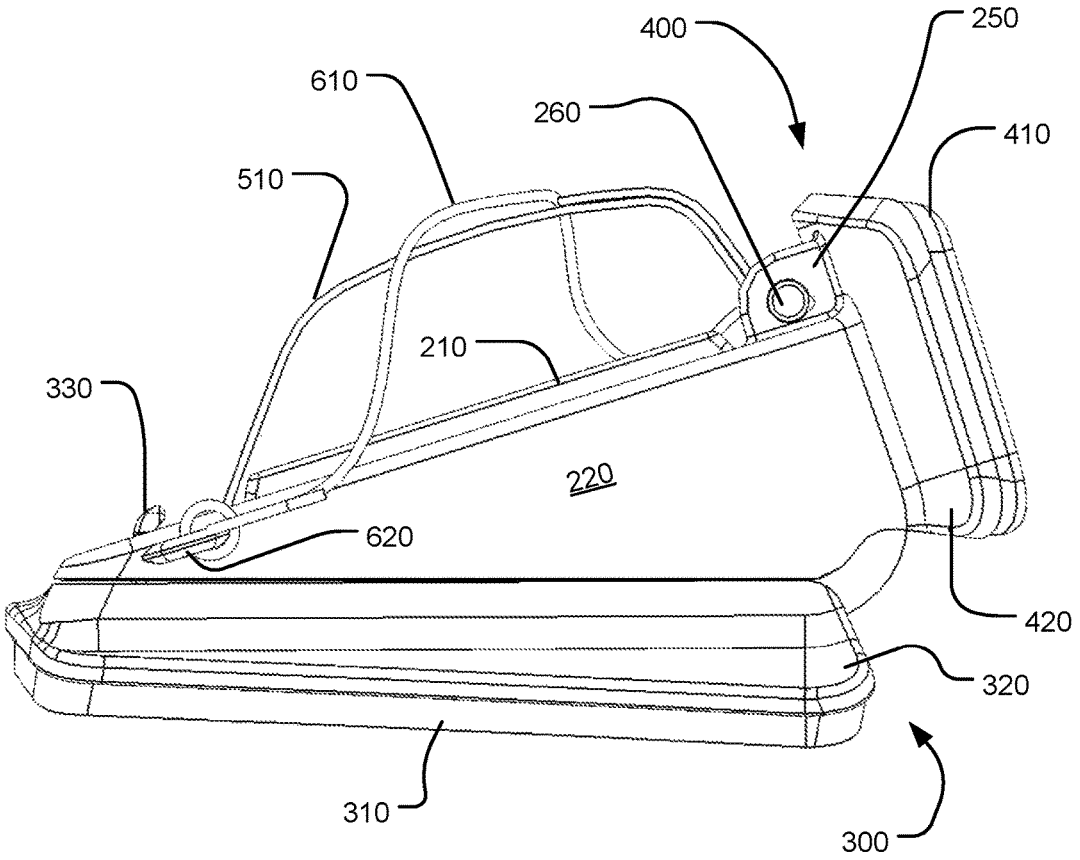
FIG. 5
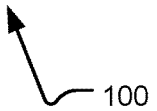

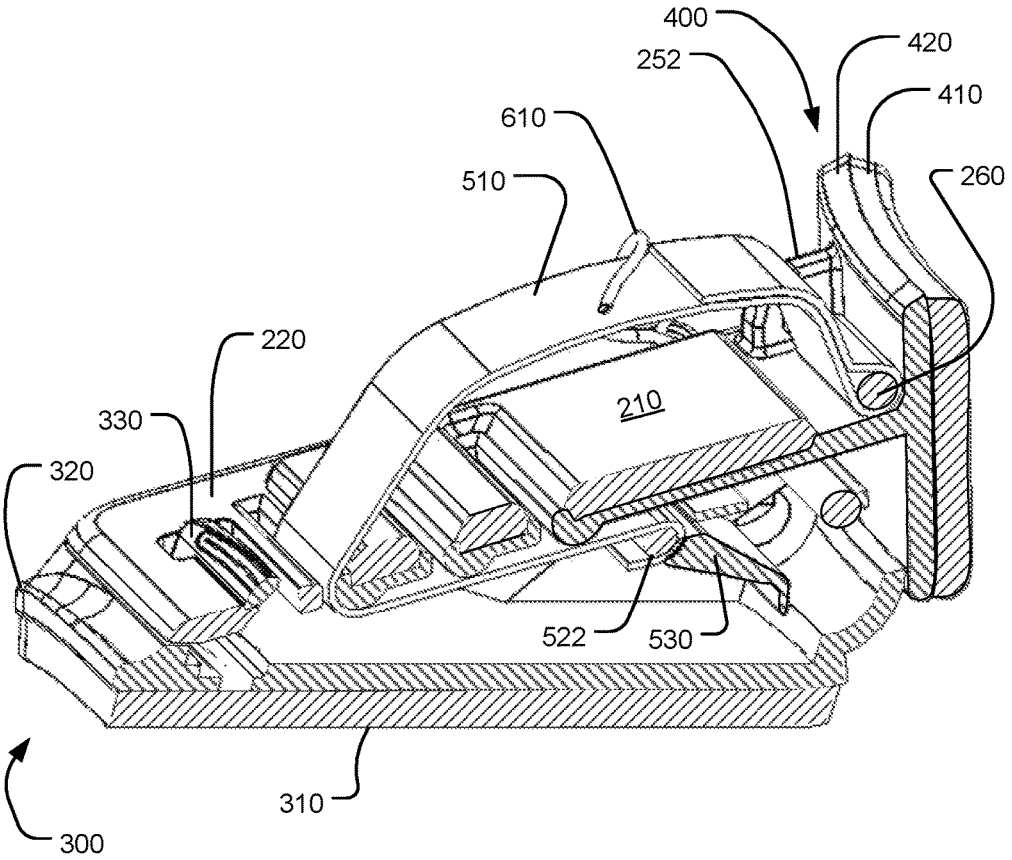
FIG. 10
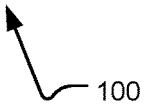

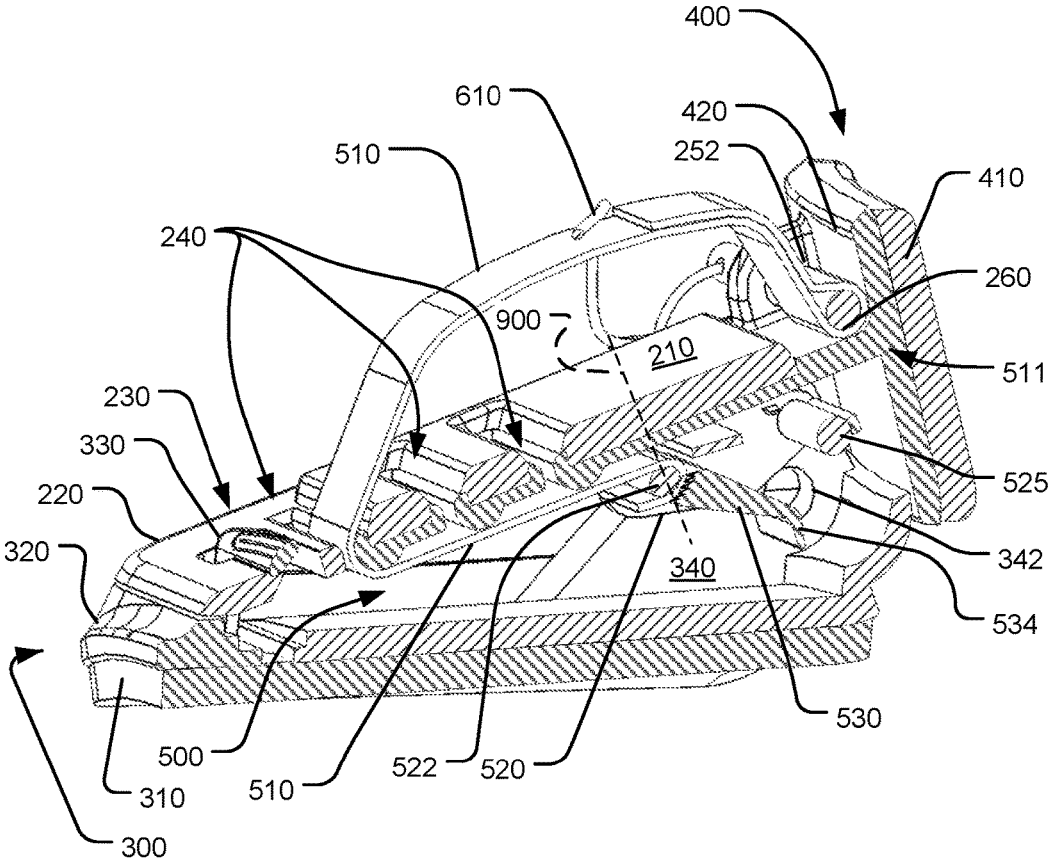
FIG. 12
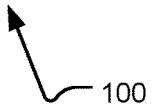

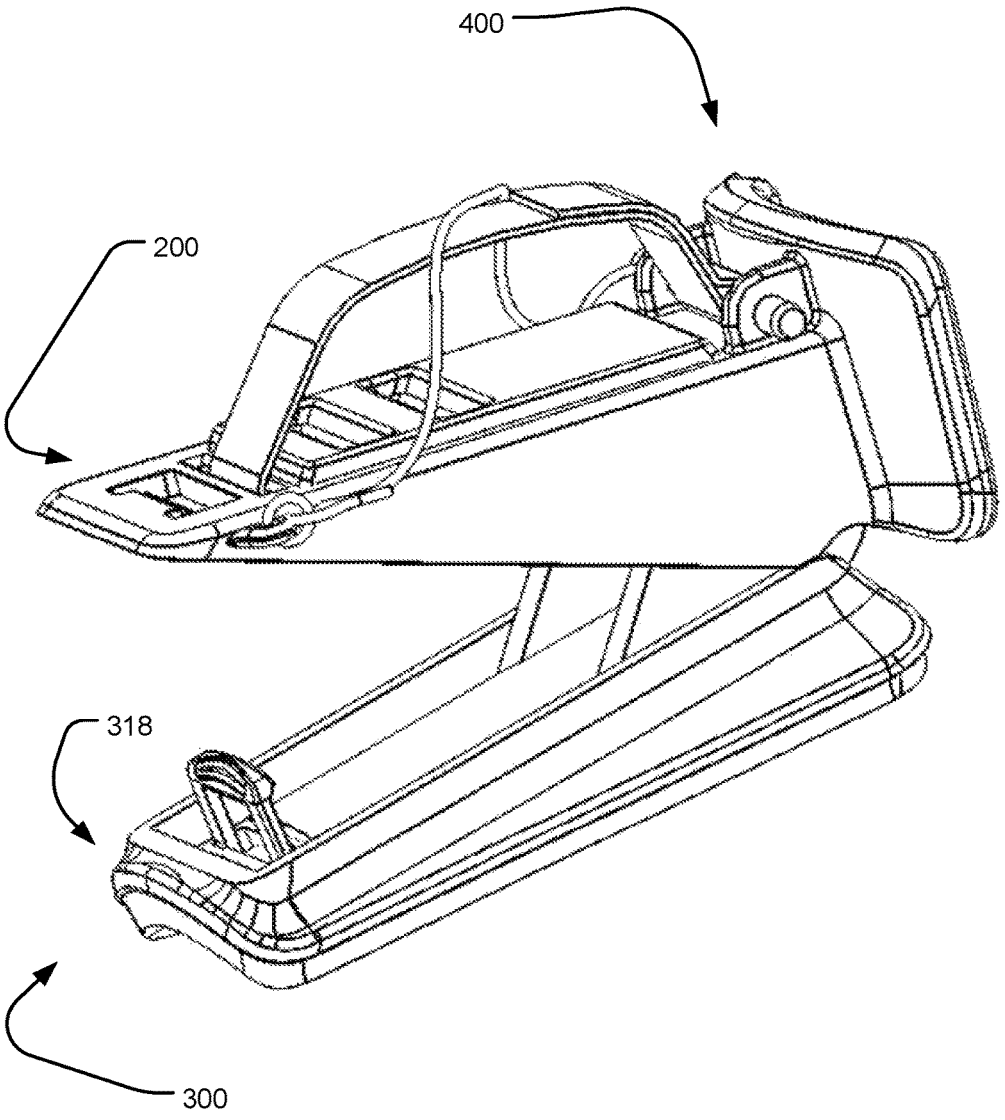
FIG. 13
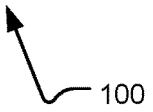

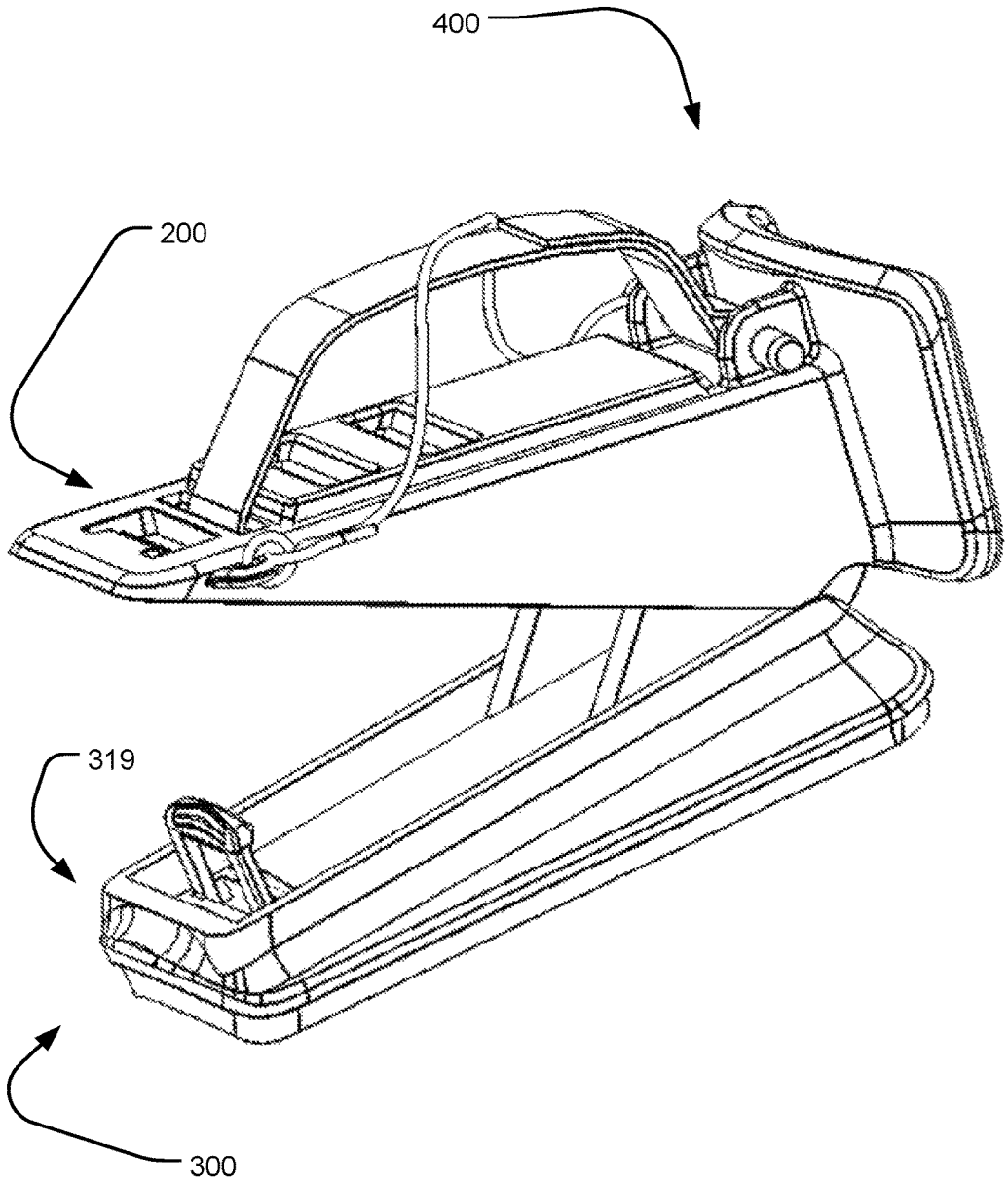
FIG. 14
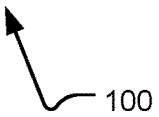

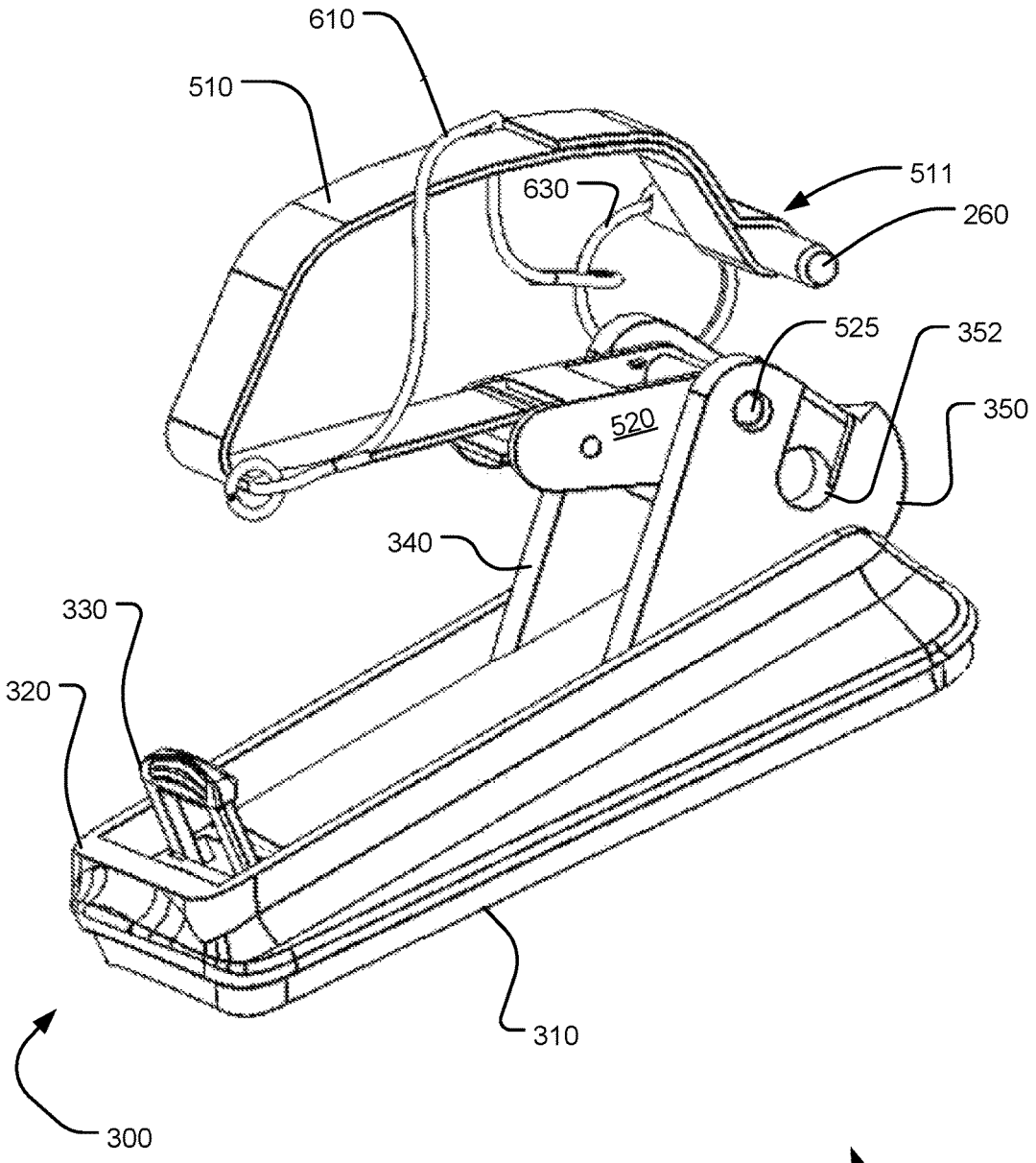
FIG. 15
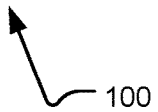

SUPPLEMENTAL SUPPORT FOR INFANT CARRIER HANDLE

TECHNICAL FIELD

The present invention relates generally to the field of child care products; more specifically, to infant carriers and accessories; and yet more specifically, to a supplemental support for infant carrier handle.

BACKGROUND

Infant carriers come in a myriad of different sizes, shapes, and styles. However, the carry handle arcing over the top of the carrier is a standard feature as it provides the necessary structure for a caregiver/parent to manipulate and carry the infant carrier. This handle, while useful, normally is quite small in diameter and so concentrates the weight of the infant and carrier over a relatively small surface area. A common method of carrying infant carriers is for a person to thread his or her forearm under the handle and rest the handle in the crook of the arm, i.e., opposite the elbow. This allows the carrier to be held close to the user's body while having the additional benefit of freeing the hand to perform other tasks. However, as mentioned above, because the infant carrier handles are normally quite small in diameter, the surface area of the handle that is pressing against the user's forearm is quite small and can quickly lead to discomfort. Furthermore, the handle is prone to slide if the user straightens his or her arm, risking a fall for the infant carrier and infant therein.

A supplemental support for infant carrier handle addresses these issues by increasing the weight-bearing surface area, adding padding, and providing additional friction to the contact so that the handle can not slip easily down the user's arm.

Yet, in the prior invention, the supplemental support for infant carrier handle could not easily and efficiently attach to all the myriads of shapes and sizes of infant carrier handles. Importantly, there are a significant number of different infant carriers, each having different handles; thus, the shape and size of a cross section of the midpoint "carry location" of infant carrier handles yields a significant amount of variety as well. In my earlier works, a supplemental support for infant carrier handle was unable to easily accommodate this variety and so attachment to various infant carrier handles was sometimes sloppy and could result in movement between the supplemental support and the infant carrier handle during use. In order to address these issues, an "insert" could be designed for each handle profile that would wrap around the infant carrier handle and provide a more standard cross section shape and size to which the supplemental support for infant carrier handle could attach. Although functional, this system of attachment was cumbersome and could be difficult to operate. What is needed is a universal attachment design that enhances the functionality of a supplemental support for infant carrier handle while obviating the need for inserts and streamlining the attachment/removal process.

BRIEF SUMMARY OF THE INVENTION

A supplemental support for infant carrier handle comprises a top clamshell, a bottom clamshell, an upper arm support, and a retention strap assembly. A safety lanyard assembly can also be incorporated therein. In order to install the supplemental support on an infant carrier handle, the retention strap is tightened over the handle, compressing the handle against the handle cushion on the top clamshell. The retention strap can be pulled snugly tight by simply pulling on the tag end of the retention strap extending out of the bottom of the top clamshell when the supplemental support is in an open configuration. Once the retention strap is snug, the user can push the bottom clamshell upwards towards the top clamshell, hinging the supplemental support into a closed configuration. Because of the unique function of the clamshell hinge (based on its location relative to the retention strap assembly), the hinging action tightens the retention strap even further upon closing. The bottom and top clamshells then lock together when a clamshell spring lock snaps into place. The supplemental support for infant carrier handle is thereby securely locked onto the infant carrier's handle and the user can simply place the bottom clamshell forearm cushion on his or her forearm, snug the upper arm support cushion against his or her upper arm, and proceed to securely and comfortably carry the infant carrier.

BRIEF DESCRIPTION OF THE DRAWINGS

FIG. 2 illustrates a perspective top and left side view of an exemplary embodiment of a supplemental support for infant carrier handle in a partially open configuration;

FIG. 5 illustrates a left side elevation view of an exemplary embodiment of a supplemental support for infant carrier handle in a closed and locked configuration;

FIG. 10 illustrates a left side cross section view of an exemplary embodiment of a supplemental support for infant carrier handle in a closed and locked configuration;

FIG. 12 illustrates a left side cross section view of an exemplary embodiment of a supplemental support for infant carrier handle in a closed and locked configuration highlighting the location of the retention pin in the final step of tightening the retention strap;

FIG. 13 illustrates a top and left side perspective view of an exemplary embodiment of a supplemental support for infant carrier handle in a partially open configuration highlighting a comfort front lip;

FIG. 14 illustrates a top and left side perspective view of an exemplary embodiment of a supplemental support for infant carrier handle in a partially open configuration highlighting a basic front lip;

FIG. 15 illustrates a top and left side perspective view of an exemplary embodiment of a supplemental support for infant carrier handle in a closed and locked configuration with the top clamshell and the forearm support removed to better illustrate internal components.

DETAILED DESCRIPTION

Figure 1:
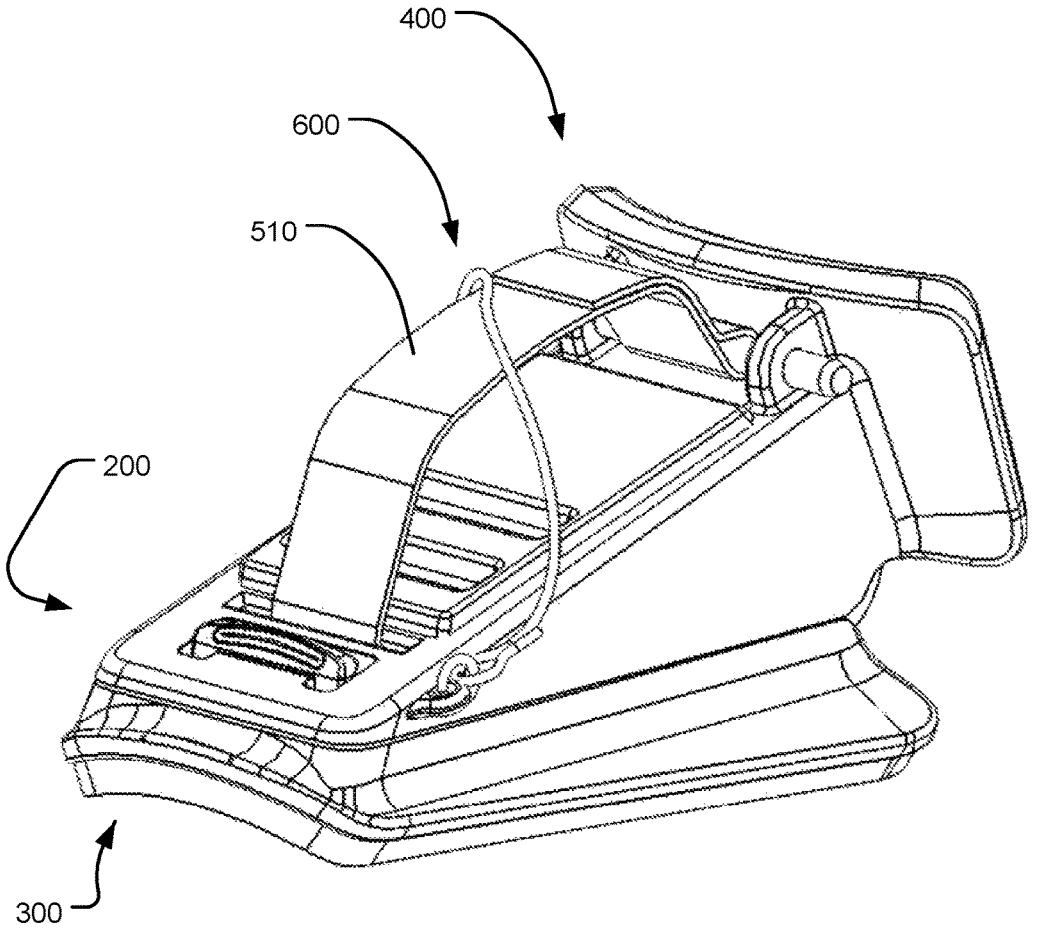
FIG. 1 illustrates a perspective top and left side view of an exemplary embodiment of a supplemental support for infant carrier handle in a closed and locked configuration.

In the following discussion, numerous specific details are set forth to provide a thorough understanding of the present disclosure. However, those skilled in the art will appreciate that embodiments may be practiced without such specific details. Furthermore, lists and/or examples are often provided and should be interpreted as exemplary only and in no way limiting embodiments to only those examples. Similarly, in this disclosure, language such as "could, should, may, might, must, have to, can, would, need to, is, is not", etc. and all such similar language shall be considered interchangeable whenever possible such that the scope of the invention is not unduly limited. For example, a comment such as: "item X is used" can be interpreted to read "item X can be used".

Exemplary embodiments are described below and in the accompanying Figures. The following detailed description provides a review of the drawing Figures in order to provide a thorough understanding of, and an enabling description for, these embodiments. One having ordinary skill in the art will understand that in some cases well-known structures and functions have not been shown or described in detail to avoid unnecessarily obscuring the description of the embodiments.

Referring now to the drawings, FIG. 1 illustrates a perspective top and left side view of an exemplary embodiment of a supplemental support for infant carrier handle 100 in a closed and locked configuration. In the embodiment in FIG. 1, the supplemental support for infant carrier handle 100 comprises a top clamshell 200, a bottom clamshell 300, an upper arm support 400, and a retention strap assembly 500 (only a portion of which—the retention strap 510 itself—is visible in FIG. 1, see later FIGs. for more details). A safety lanyard assembly 600 can also be incorporated therein.

In order to install the supplemental support 100 on an infant carrier handle, the retention strap 510 is tightened over the handle, compressing the handle against the handle cushion on the top clamshell 200. The retention strap 510 can be pulled snugly tight by simply pulling on the tag end of the retention strap (not shown in FIG. 1, see FIG. 10) extending out of the bottom of the top clamshell 200 when the supplemental support 100 is in an open configuration. The tag end can also be called the distal end since the proximal end of the retention strap is removably attached to the top clamshell 200. An initial tightening of the retention strap 510 is accomplished by simply pulling on the distal end of the retention strap. Once the retention strap 510 is snug (i.e., initially tightened), the user can push the bottom clamshell 300 upwards towards the top clamshell 200, hinging the supplemental support 100 into a closed configuration. Because of the unique function of the clamshell hinge (based on its location relative to the retention strap assembly 500), the hinging action tightens the retention strap 510 even further upon closing. The bottom clamshell 300 and top clamshell 200 then lock together when a clamshell spring lock 330 (see FIG. 2) snaps into place. The supplemental support for infant carrier handle 100 is thereby securely locked onto the infant carrier's handle and the user can simply place the bottom clamshell 300 forearm cushion on his or her forearm, snug the upper arm support 400 cushion against his or her upper arm, and proceed to securely and comfortably carry the infant carrier.

FIG. 2 illustrates a perspective top and left side view of an exemplary embodiment of a supplemental support for infant carrier handle 100 in a partially open configuration. Note that the clamshell spring lock 330 is disengaged and the clamshells 200 and 300 are hinged slightly apart from one another in this illustration. In this view, the top clamshell support structure 220 can be seen; it forms the main body of the top clamshell 200 and connects the top clamshell 200 to the upper arm support 400.

In the front or distal end of the top clamshell support structure 200 is the spring lock port 230, which, together with the spring lock 330 act to lock the top and bottom clamshells together. In the embodiment illustrated in FIG. 2, the spring lock 330 and spring lock port 230 are shaped with a tab and protrusion; other configurations that provide alternate means of locking the two clamshells together are contemplated in other embodiments.

In the embodiment illustrated in FIG. 2, the retention strap 510 is being fed through the most distal of a plurality of strap ports 240 in the top clamshell 200. This configuration allows the supplement support 100 to accommodate an infant carrier handle that has a relatively large cross sectional area in the space between the retention strap 510 and the handle cushion 210. For smaller/narrower handles, the retention strap 510 can be fed into one of the more proximal strap ports 240 to ensure a more snug fit.

A safety lanyard assembly 600 can comprise a safety lanyard 610 attaching to the top clamshell 200 at a lanyard mount 620. The safety lanyard 610 is designed to be placed over the infant carrier handle and then lock in place so that if the retention strap 510 fails, there remains a backup means of securing the supplemental support on the infant carrier handle. The safety lanyard 610 can also serve an additional purpose: by attaching to the strap mount pin 260 (see FIG. 4), the safety lanyard 610 can ensure the strap mount pin 260 is not lost or misplaced when the pin 260 is disconnected from the plurality of mount pin pylons 250 and 252 (see FIG. 4 for an illustration of pin pylon 252) on the top clamshell 200.

FIG. 2 also highlights the two arm cushions: the upper arm cushion 410 that is part of the upper arm support 400 and the forearm cushion 310 that is part of the bottom clamshell 300. The cushions 310 and 410 serve to pad the supplemental support so that the user's arm experiences minimal pressure point discomfort when carrying an infant in an infant carrier with the supplement support 100. The upper arm cushion 410 is mounted to the upper arm support structure 420 while the forearm cushion 310 is mounted to the underside of the bottom clamshell support structure 320. The support structures 220 and 320 distribute the weight of the supplemental support 100, infant carrier and infant across a wide surface area so as to further ensure the comfort of the user when employing the supplement support 100.

Note that the top clamshell support structure 220 attaches via the clamshell hinge assembly to the bottom clamshell 300 at proximal ends of both components so that when the hinge is operated, the distal ends of the components separate from each other and "open" while the proximal ends remain in contact and connected to each other by the hinge. Hence, the "clamshell" appearance of the device when open (compare FIGS. 1 and 3).

Figure 3:
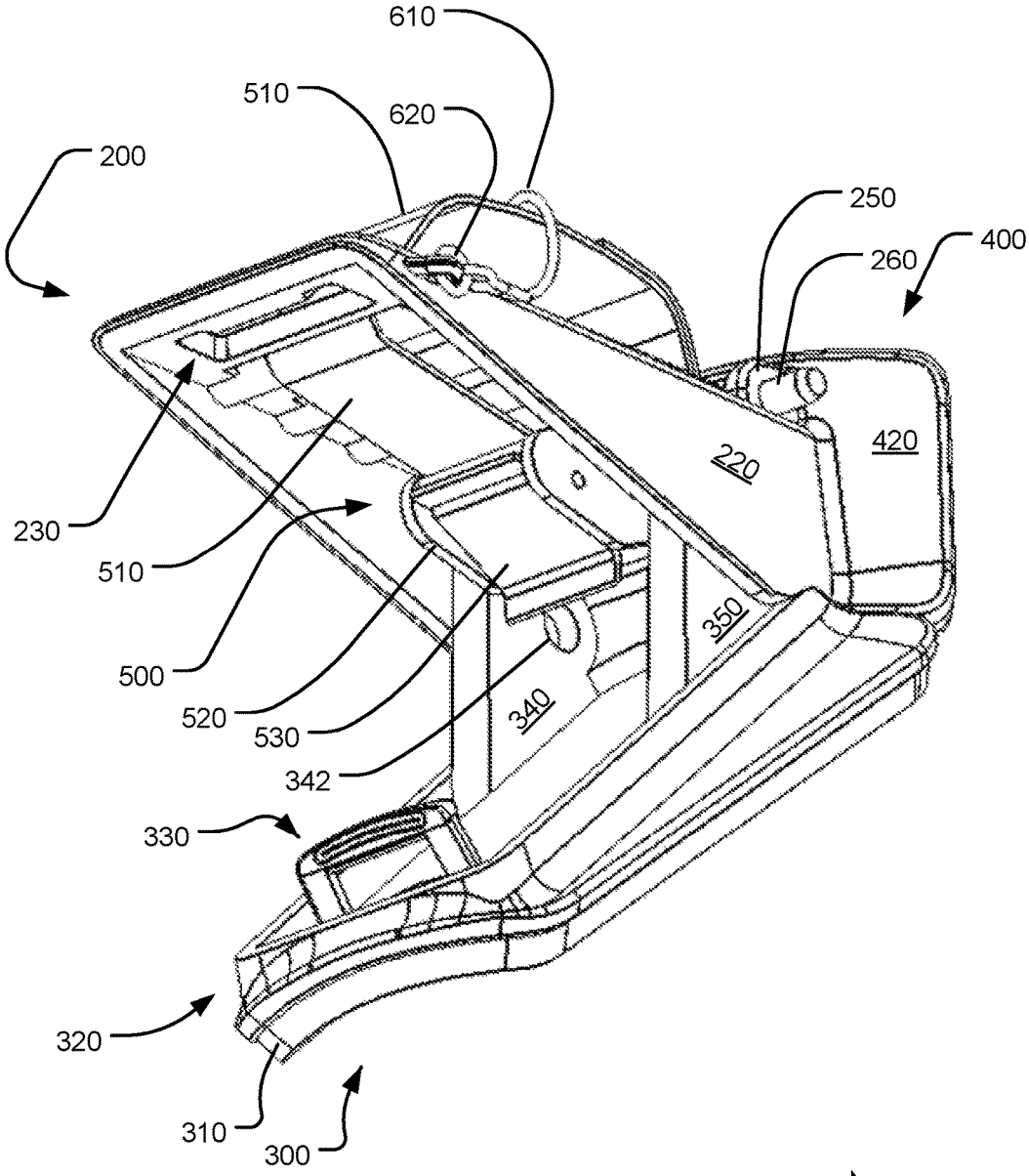
FIG. 3 illustrates a perspective front and left side view of an exemplary embodiment of a supplemental support for infant carrier handle in an open configuration.

FIG. 3 illustrates a perspective front and left side view of an exemplary embodiment of a supplemental support for infant carrier handle 100 in an open configuration. In this illustration, the internal structures and components of the supplement support 100 can be seen.

Additional components of the retention strap assembly 500 can include the retention strap 510, the retention strap lock 520, the binder lever 530, and a retention pin 522 (see later FIGs. for this component). The retention strap 510 is fed through the retention strap lock 520 and the binder lever 530 portion of the retention strap lock ensures the strap is locked tightly in place so it can not pull back out of the retention strap lock 520 unless the binder lever 530 is released.

In FIG. 3, the bottom clamshell hinge pylons 340 and 350 are illustrated. These components of the bottom clamshell 300 extend upwards from the bottom clamshell support structure 320 and function as mounting locations for the retention strap lock 520 and the clamshell hinge assembly. In fact, one of the hinge ports 342 can be seen on the first hinge pylon 340. A corresponding hinge pin 242 (not shown in FIG. 3, see FIG. 16) fits into the hinge port 342 and, along with the other hinge pin 252 (see FIG. 16) and hinge port 352 (see FIG. 15), these components make up the clamshell hinge assembly which hingeably attaches the top and bottom clamshells 200 and 300 to each other.

Figure 4:
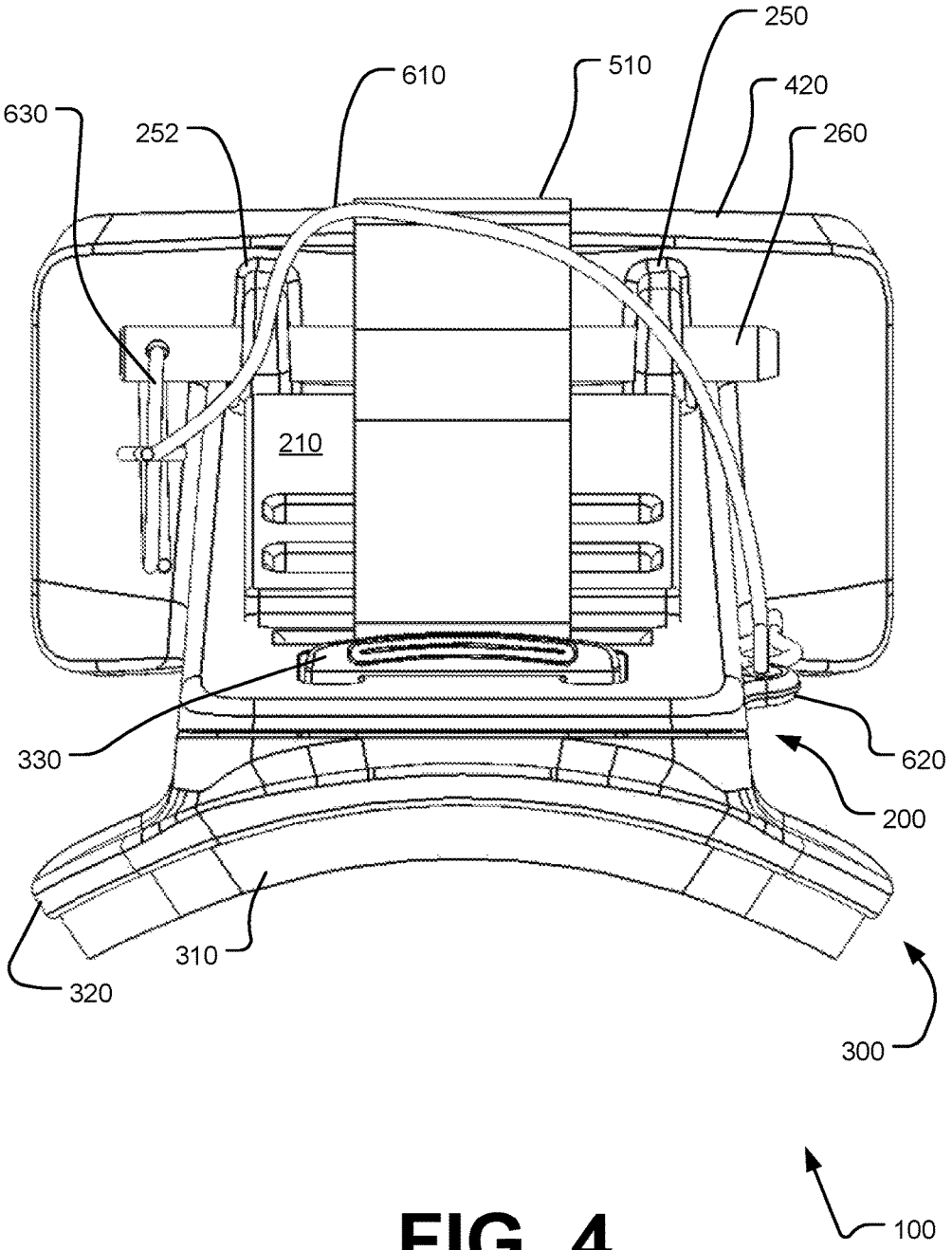
FIG. 4 illustrates a front elevation view of an exemplary embodiment of a supplemental support for infant carrier handle in a closed and locked configuration.

FIG. 4 illustrates a front elevation view of an exemplary embodiment of a supplemental support for infant carrier handle 100 in a closed and locked configuration. In this view, the curved nature of the forearm support structure 320 and forearm cushion 310 is visible. This curve wraps over and around the user's forearm, providing an ergonomic fit that helps to evenly distribute the weight of the supplemental support (and any infant carrier and infant therein being suspended by the supplemental support) across the forearm so as to minimize uncomfortable pressure points when carrying an infant carrier. The bottom surface of the bottom clamshell 300 thus resembles an inside surface of a hollow horizontal cylindrical segment without end caps (i.e., just a portion of the sidewall of a hollow cylinder), the cylinder extending from the proximal end of the bottom clamshell to its distal end. The cylindrical segment can be formed to more closely match the surface of a person's forearm. In fact, in some embodiments, a custom bottom clamshell surface can be configured for a particular user to most closely match the dimensions of that user's forearm.

FIG. 5 illustrates a left side elevation view of an exemplary embodiment of a supplemental support for infant carrier handle 100 in a closed and locked configuration. In the embodiment illustrated in FIG. 5, the upper arm support 400 is shown as being at less than a ninety degree angle to the forearm cushion 310. This allows the user to keep his or her forearm slightly raised so that the hand is higher than the elbow, which ensures that the supplemental support 100 stays trapped in the crook of the user's arm. In other embodiments, this angle can be less than or greater than that shown in FIG. 5.

Figure 6:
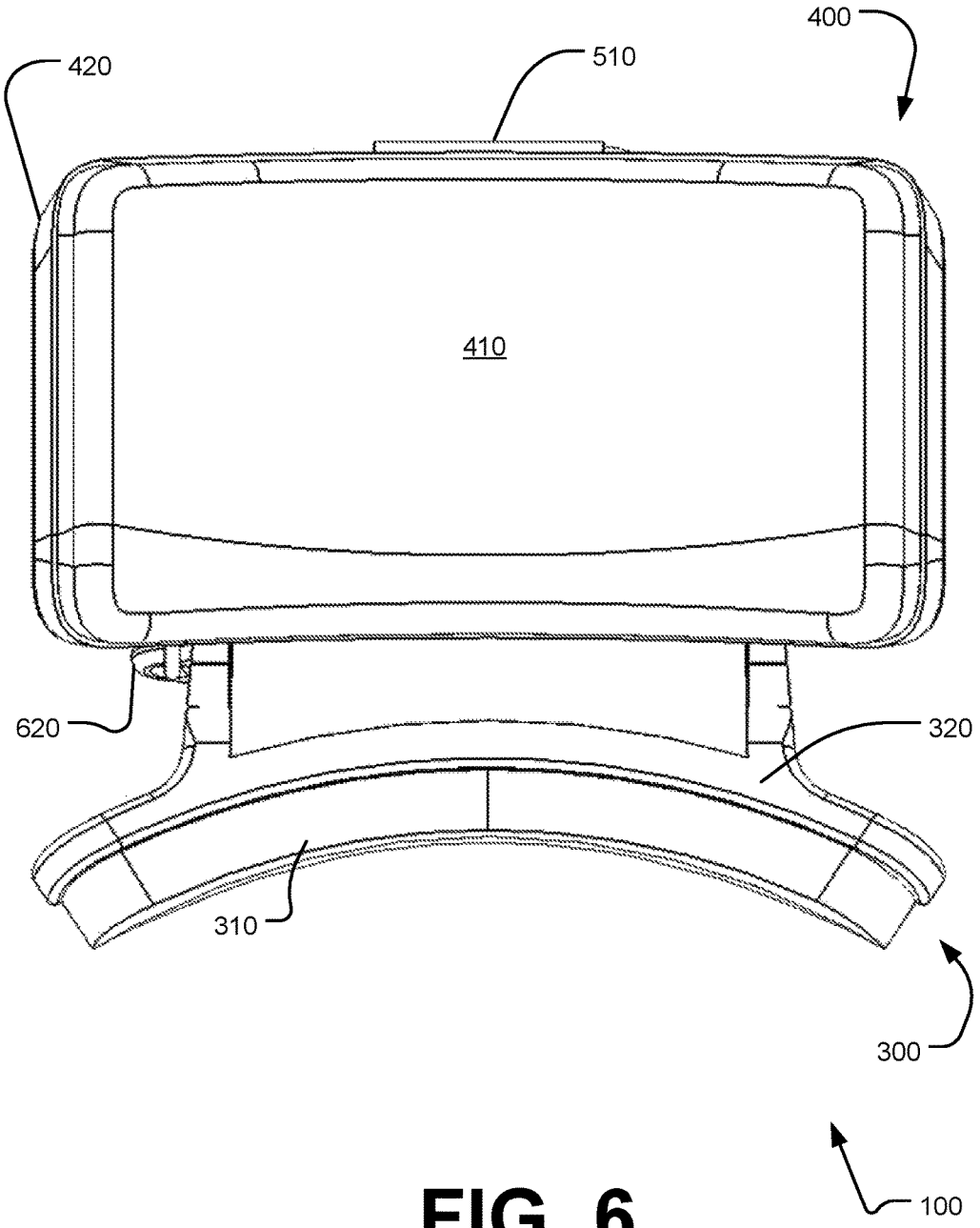
FIG. 6 illustrates a rear elevation view of an exemplary embodiment of a supplemental support for infant carrier handle in a closed and locked configuration.

FIG. 6 illustrates a rear elevation view of an exemplary embodiment of a supplemental support for infant carrier handle 100 in a closed and locked configuration. In this view, the curved nature of the forearm support structure 320 and forearm cushion 310 is visible. This curve wraps over and around the user's forearm, providing an ergonomic fit that helps to evenly distribute the forces across the forearm so as to minimize uncomfortable pressure points when carrying an infant carrier.

Figure 7:
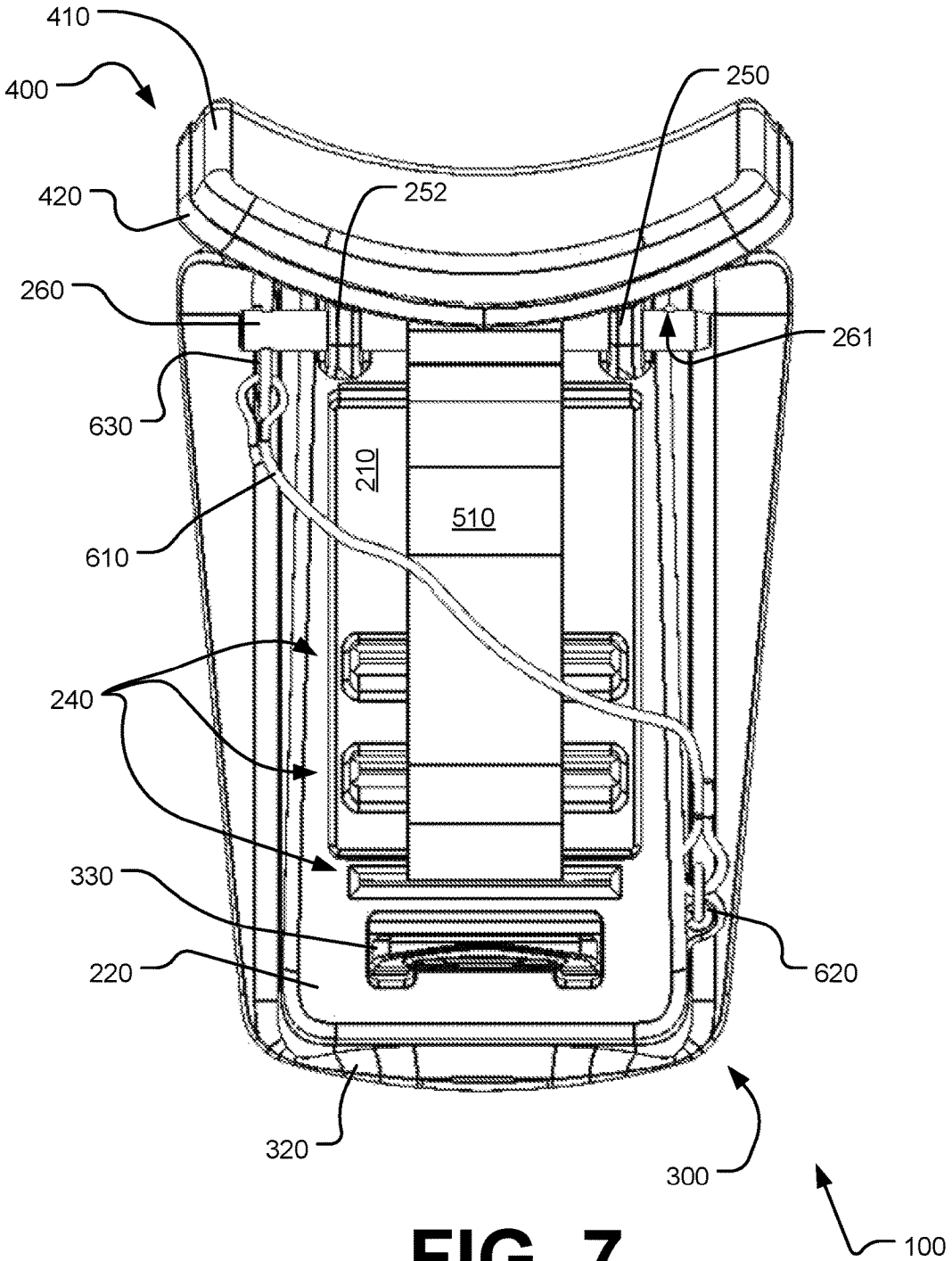
FIG. 7 illustrates a top plan view of an exemplary embodiment of a supplemental support for infant carrier handle in a closed and locked configuration.

FIG. 7 illustrates a top plan view of an exemplary embodiment of a supplemental support for infant carrier handle 100 in a closed and locked configuration. In this view, the curved nature of the upper arm support structure 420 and upper arm cushion 410 is visible. This curve wraps around the user's upper arm, providing an ergonomic fit that helps to evenly distribute the forces across the upper arm so as to minimize uncomfortable pressure points when carrying an infant carrier.

The outer surface of the upper arm cushion 410 thus resembles an inside surface of a hollow horizontal cylindrical segment without end caps (i.e., just a portion of the sidewall of a hollow cylinder), the cylinder extending from an upper distal end of the upper arm cushion 410 to its lower proximal end. The cylindrical segment can be formed to more closely match the corresponding surface of a person's upper arm, said arm surface being that portion which the upper arm cushion 410 might contact during use of the supplemental support to carry an infant carrier.

FIG. 7 also illustrates the safety lanyard assembly 600 fully as the lanyard mount 620, the strap mount pin 260 and mount pin connector 630 are all visible. Note how the strap mount pin 260 passes through the plurality of mount pin pylons 250 and 252, trapping the proximal end of the retention strap 510 therebetween. The strap mount pin keeper 261 ensures that the strap mount pin 260 stays in place unless the user forcibly removes the pin. In the embodiment in FIG. 7, the pin keeper 261 is a spring-loaded, pop up button or ball bearing that impacts the mount pin pylon 250. In one embodiment, the pin keeper 261 is shaped so that when sufficient pulling force is applied to remove the strap mount pin 260, the pin keeper 261 contacts the pylons and automatically depresses; however, vibration, gravity, etc. do not provide sufficient force to actuate the pin keeper 261. The pop-up pin keeper 261 thus retards inadvertent removal of the strap mount pin 260 to ensure the retention strap stays snugly in place during use.

Figure 8:
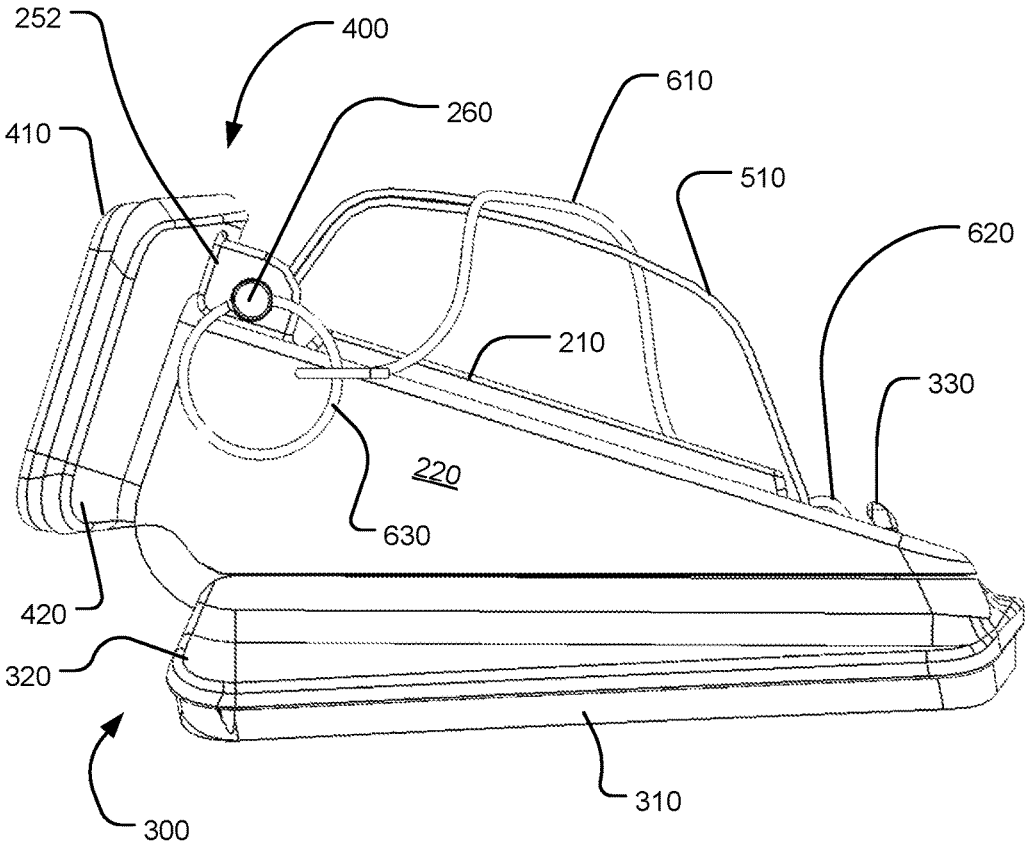
FIG. 8 illustrates a right side elevation view of an exemplary embodiment of a supplemental support for infant carrier handle in a closed and locked configuration.
Figure 8:
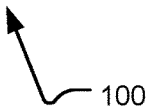

FIG. 8 illustrates a right side elevation view of an exemplary embodiment of a supplemental support for infant carrier handle 100 in a closed and locked configuration. In this view, additional details of the safety lanyard assembly 600 can be seen.

Figure 9:
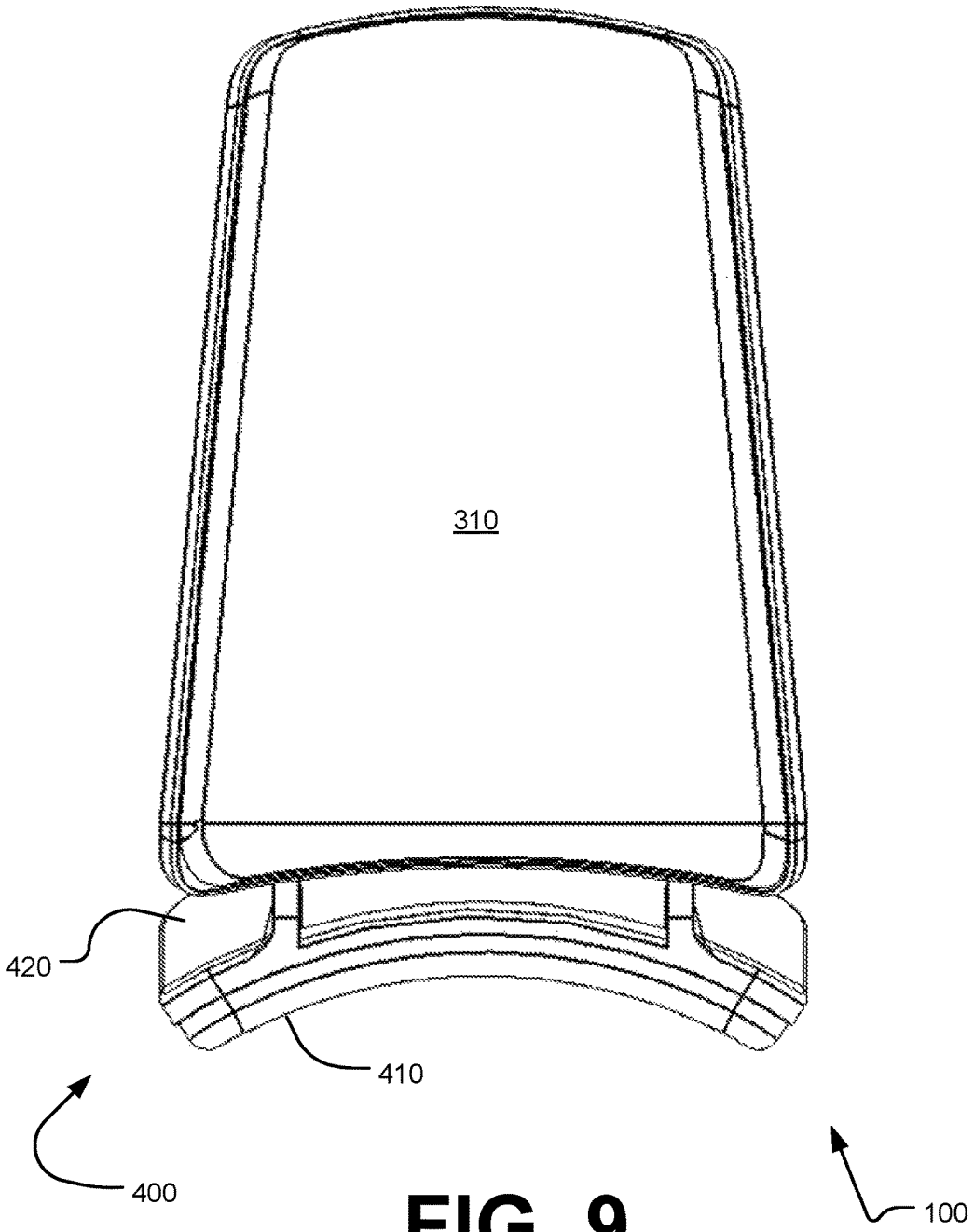
FIG. 9 illustrates a bottom plan view of an exemplary embodiment of a supplemental support for infant carrier handle in a closed and locked configuration.

FIG. 9 illustrates a bottom plan view of an exemplary embodiment of a supplemental support for infant carrier handle 100 in a closed and locked configuration. In this view, the large surface area of the forearm cushion 310 is apparent.

FIG. 10 illustrates a left side cross section view of an exemplary embodiment of a supplemental support for infant carrier handle 100 in a closed and locked configuration. The cross section view provides a clear illustration of the path taken by the retention strap 510 through the supplemental support 100. In the embodiment illustrated in FIG. 10, the retention strap 510 is threaded through the most distal of the strap ports. In other embodiments a more proximal strap port can be utilized. Also, the plurality of strap ports 240 shown in FIG. 10 numbers three, more or fewer strap ports are contemplated in alternate embodiments.

Figure 11:
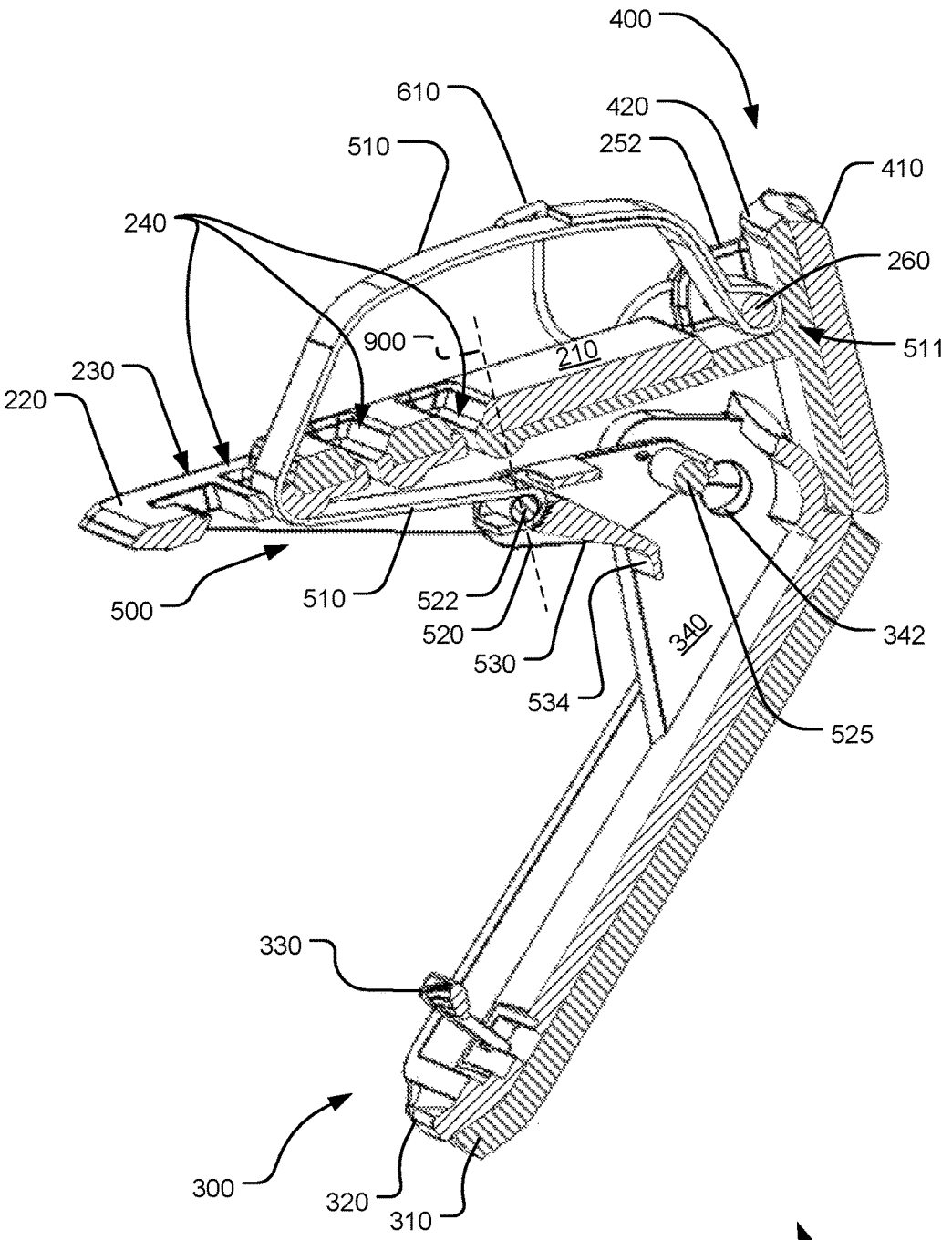
FIG. 11 illustrates a left side cross section view of an exemplary embodiment of a supplemental support for infant carrier handle in an open configuration highlighting the location of the retention pin in the initial step of tightening the retention strap.

Turning now to FIGS. 11 and 12, a supplemental support for infant carrier handle 100 is shown in cross-sectional side views. In FIG. 11, the top clamshell 200 is shown open about sixty degrees versus a closed position shown in FIG. 12. More specifically, FIG. 11 illustrates a left side cross section view of an exemplary embodiment of a supplemental support for infant carrier handle in an open configuration highlighting the location of the retention pin 522 in the initial step of tightening the retention strap while FIG. 12 illustrates a left side cross section view of an exemplary embodiment of a supplemental support for infant carrier handle in a closed and locked configuration highlighting the location of the retention pin 522 in the final step of tightening the retention strap.

In both FIGs., the path taken by the retention strap 510 through the supplemental support 100 is shown in detail. Although not illustrated in these Figures, the infant carrier handle would be placed under the retention strap 510 in the open space between the strap 510 and the handle cushion 210. The retention strap 510 then feeds down through one of the plurality of strap ports 240 that provide access through the top clamshell 200 into the interior of the supplemental support for infant carrier handle 100. In the embodiments illustrated in FIGS. 11 and 12, the outermost strap port 240 is used to accommodate a particularly wide (in cross section) infant carrier handle. If the supplemental support 100 is used with an infant carrier that has a narrower handle, the retention strap 510 can be fed through one of the other strap ports 240 in order to minimize any potential play that would allow the handle to shift or slide once the retention strap 510 is properly tightened over the handle.

Regardless of which strap port 240 is employed, the retention strap 510 then feeds into the retention strap lock 520. The retention strap lock 520 functions to lock down what would otherwise be a loose or "tag" end of the retention strap 510. More importantly, the retention strap lock 520, also serves to strongly tighten the retention strap 510 around the infant carrier handle.

In the embodiments illustrated in FIGS. 11 and 12, the retention strap lock 520 utilizes a retention pin 522 around which the retention strap 510 is curled. A binder lever 530 presses against the retention strap 510 and holds it against the retention pin 522. The binder lever 530 can employ grip teeth, a rough surface, etc. to lightly "bite" into the retention strap 510 and keep it in place. The harder the strap 510 is pulled back out of the grip of the binder lever 530 and retention pin 522, the harder the binder lever 530 digs into the strap and compresses it against the retention pin 522. However, it remains easy for a user to loosen the retention strap 510 by simply pressing upwards on the binder lever release 534, which draws the binder lever 530 away from the retention pin 522, releasing the retention strap 510.

Once a user has snuggly pulled the retention strap 510 against the infant carrier handle and checked to ensure that the binder lever 530 is engaging the retention strap 510 and compressing it against the retention pin 522, the user can close the bottom clamshell 300 upwards against the top clamshell 200. This closing action causes the retention strap lock 520 to pivot back towards the upper arm support 400, thereby drawing the retention strap 510 tight. Compare the position of the retention pin 522 in relation to the top plate in FIG. 11 versus FIG. 12 (a dashed location line 900 is shown passing through the retention pin 522 in the Figures in order to make this comparison stand out). As can be seen by the movement of the location line 900, the retention strap lock 520 has moved back from the plurality of strap ports 240, drawing the retention strap 510 with it back towards the upper arm support 400.

The above pivot action occurs because of the relative attachment locations of the retention strap lock 520 and the hinge pins 242 and 252 on the bottom clamshell 300. The retention strap lock 520 is rotatably attached to the bottom clamshell 300 via the lock attachment pin 525 passing through the two bottom clamshell hinge pylons 340 and 350. The top clamshell 200 is hingedly attached to the bottom clamshell 200 via the hinge pins 242 and 252 on the top clamshell 200 rotatably attaching into the hinge ports 342 and 352 in the bottom clamshell hinge pylons 340 and 350. Note how the lock attachment pin 525 is located forward of the hinge port 342 when the clamshells are in the open configuration shown in FIG. 11. Now, as the bottom clamshell 300 hinges upwards to close against the top clamshell 200, the rotation of the bottom clamshell 300 about the hinge port 342 causes the lock attachment pin 525 mounting location on the hinge pylons 340 and 350 to be drawn rearwards away from the strap ports 240 of the top clamshell 200. Because the retention strap lock 520 is mounted to the hinge pylons 340 and 350 and the retention strap 510 is locked into the retention strap lock 520, the action of rotating the bottom clamshell 300 up to close it against the top clamshell 200 necessarily pivots the mounting location of the retention strap lock 520 rearwards away from the strap ports 240, causing the retention strap lock 520 itself to move rearwards away from the strap ports 240, causing the retention strap 510, which is fixed in the retention strap lock 520 to be pulled rearwards, and thus tightening the strap 510. Conversely, opening the bottom clamshell 300, pivots the mounting location of the retention strap lock 520 forwards towards the strap ports 240, thereby loosening the retention strap 510. Thus, when in the open configuration, the distance between the most distal of the plurality of strap ports and the mounting location equals a first length and when in the closed configuration the distance equals a second length. The second length is greater than the first length.

FIGS. 13 and 14 illustrate top and left side perspective views of exemplary embodiments of supplemental supports for an infant carrier handle in partially open configurations highlighting a comfort front lip 318 (see FIG. 13) versus a basic front lip 319 (see FIG. 14) on the bottom clamshell support structure 320. The comfort front lip 318 flares upward to ensure user comfort. Without this upward flare, the front lip might contact the user's forearm and create an uncomfortable pressure point there. Embodiments employing various types of front lips are contemplated.

FIG. 15 illustrates a top and left side perspective view of an exemplary embodiment of a supplemental support for infant carrier handle 100 in a closed and locked configuration with the top clamshell 200 and the forearm support 400 removed to better illustrate internal components. The mounting of the retention strap lock 520 between the bottom clamshell hinge pylons 340 and 350 is shown in this Figure. Also, note the second clamshell hinge port 352, this is a component of the clamshell hinge assembly that was not illustrated earlier.

Figure 16:
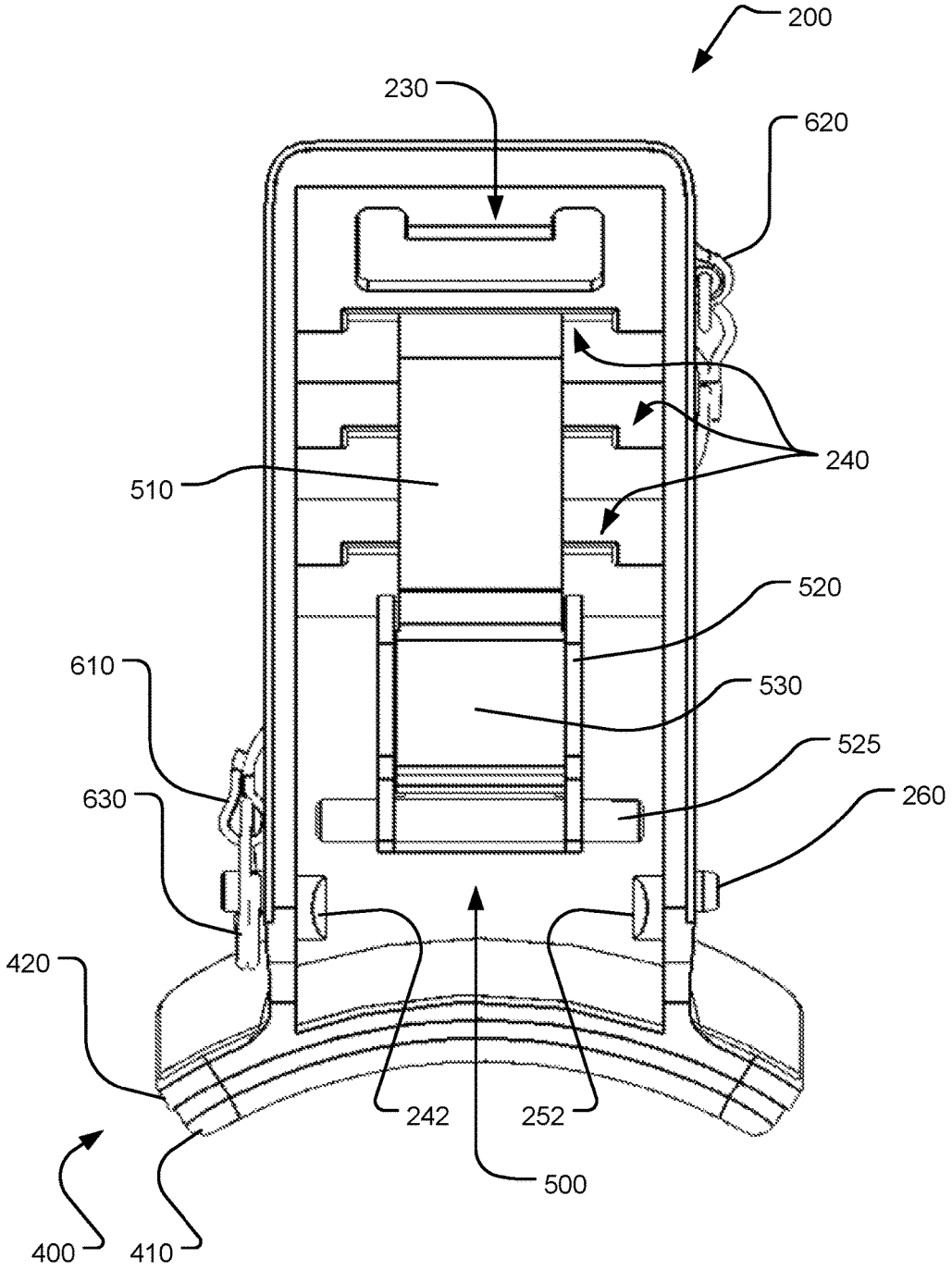
FIG. 16 illustrates a bottom plan view of an exemplary embodiment of a supplemental support for infant carrier handle in a closed and locked configuration with the bottom clamshell removed to better illustrate internal components.

FIG. 16 illustrates a bottom plan view of an exemplary embodiment of a supplemental support for infant carrier handle 100 in a closed and locked configuration with the bottom clamshell 300 removed to better illustrate internal components. For example, the plurality of hinge pins 242 and 252 are visible in this illustration. They fit into the plurality of hinge ports 342 and 352 on the bottom clamshell hinge pylons 340 and 350. These components together function to allow the bottom clamshell 300 to hinge downwards from the top clamshell 200 in order to open the clamshells and adjust the retention strap 510, and then to hinge upwards once again to lock the clamshells together. In this view, the underside of the top clamshell 200 is highlighted.

The unique and novel elements of the supplemental support for infant carrier handle can not be overemphasized.

First, as explained in detail above, the supplemental support can fit on a wide variety of infant carrier handles without the need for any additional insert or other device for wrapping around a handle and thereby creating a standard size/shape object to which a supplemental support could be attached. Additionally, the supplemental support for infant carrier handle has the significant ability to be easily and simply removed and reattached without reconfiguring the entire device. Once set for a particular infant carrier handle, the device can be removed and reattached without operating the binder lever 530 and pulling the tag end of the retention strap completely out of the strap port (and also disconnecting the safety lanyard). Instead, one simply opens the clamshells (thereby releasing the tension on the retention strap 510) and then pulls the strap mount pin 260, thus freeing the proximal end of the retention strap and simultaneously freeing the safety lanyard 610. The device then drops free of the infant carrier handle. However, it remains sized and configured correctly for quick reattachment: simply (1) place the underside of the infant carrier handle against the handle cushion 210; (2) pull the retention strap 510 back into position over the carrier handle and insert the strap mount pin 260 through the first mount pin pylons 252, then through the loop 511 on the proximal end of the retention strap 510 and on through the second mount pin pylon 250; and then (3) close the bottom clamshell 300 up against the top clamshell 200. Note than other embodiments, the retention strap 510 can employ other means of terminating the proximal end thereof and attaching said end to the supplemental support for infant carrier handle. For example, the proximal end could feed through a slot in the strap mount pin 260 and then the portion that protrudes from the other side of the pin 260 could be clamped off. Other options are contemplated.

While particular embodiments have been described and disclosed in the present application, it is clear that any number of permutations, modifications, or embodiments may be made without departing from the spirit and the scope of this disclosure.

Particular terminology used when describing certain features or aspects of the embodiments should not be taken to imply that the terminology is being redefined herein to be restricted to any specific characteristics, features, or aspects with which that terminology is associated. In general, the terms used in the following claims should not be construed to be limited to the specific embodiments disclosed in the specification, unless the above Detailed Description section explicitly defines such terms. Accordingly, the actual scope of the claims encompasses not only the disclosed embodiments, but also all equivalent ways of practicing or implementing the claimed subject matter.

The above detailed description of the embodiments is not intended to be exhaustive or to limit the disclosure to the precise embodiments or forms disclosed herein or to the particular fields of usage mentioned above. While specific embodiments and examples are described above for illustrative purposes, various equivalent modifications are possible within the scope of the disclosure, as those skilled in the relevant art will recognize. Also, the teachings of the embodiments provided herein can be applied to other systems, not necessarily the system described above. The elements and acts of the various embodiments described above can be combined to provide further embodiments.

Any patents, applications and other references that may be listed in accompanying or subsequent filing papers, are incorporated herein by reference. Aspects of embodiments can be modified, if necessary, to employ the systems, functions, and concepts of the various references to provide yet further embodiments.

In light of the above "Detailed Description," the Inventor may make changes to the disclosure. While the detailed description outlines possible embodiments and discloses the best mode contemplated, no matter how detailed the above appears in text, embodiments may be practiced in a myriad of ways. Thus, implementation details may vary considerably while still being encompassed by the spirit of the embodiments as disclosed. As discussed herein, specific terminology used when describing certain features or aspects should not be taken to imply that the terminology is being redefined herein to be restricted to any specific characteristics, features, or aspects of the embodiments with which that terminology is associated.

While certain aspects are presented below in certain claim forms, the inventor contemplates the various aspects in any number of claim forms. Accordingly, the inventor reserves the right to add additional claims after filing the application to pursue such additional claim forms for other aspects.

The above specification, examples and data provide a description of the structure and use of exemplary implementations of the described systems, articles of manufacture and methods. It is important to note that many implementations can be made without departing from the spirit and scope of the invention.

What is claimed is:

1. A supplemental support for an infant carrier handle, comprising:

a top clamshell having a top clamshell support structure with a top clamshell support structure proximal end and a top clamshell support structure distal end;

a bottom clamshell with a bottom clamshell proximal end and a bottom clamshell distal end;

the bottom clamshell proximal end hingeably attached to the top clamshell support structure proximal end via a clamshell hinge assembly such that the bottom clamshell distal end swings upwards to close against an underside of the top clamshell when in a closed configuration and the bottom clamshell distal end swings downwards away from the underside of the top clamshell when in an open configuration;

a retention strap assembly having a retention strap and a retention strap lock;

the retention strap extending from a strap proximal end to a strap distal end;

the strap proximal end attached to the top clamshell and the retention strap configured to wrap over and tighten against a handle of an infant carrier;

the strap distal end feeding through one of a plurality of strap ports in a top surface of the top clamshell and into the retention strap lock;

the retention strap lock lockably connecting the retention strap to the bottom clamshell wherein the retention strap lock is connected to the bottom clamshell at a mounting location;

a distance between a most distal of the plurality of strap ports and the mounting location equals a first length when in the open configuration and the distance equals a second length when in the closed configuration, and wherein the second length is greater than the first length such that closing the bottom clamshell against the top clamshell functions to tighten the retention strap; and a bottom surface of the bottom clamshell extending longitudinally from the bottom clamshell distal end to the bottom clamshell proximal end and having a transverse cross section taken perpendicular thereto which is curved so as to comfortably fit over a curved upper surface of a user's forearm and distribute widely thereacross a weight of the supplemental support for infant carrier handle.

2. The supplemental support for an infant carrier handle of claim 1, further comprising:

a handle cushion placed on an upper surface of the top clamshell support structure between the retention strap and the top clamshell support structure and designed to compress when an object is placed thereon.

3. The supplemental support for an infant carrier handle of claim 1, wherein the retention strap is initially tightened by pulling on the distal end of the retention strap.

4. The supplemental support for an infant carrier handle of claim 2, wherein the retention strap is initially tightened against the handle of the infant carrier by pulling on the distal end of the retention strap, thereby pressing the handle downwards into the handle cushion which is compressed.

5. The supplemental support for an infant carrier handle of claim 1, wherein the bottom clamshell and top clamshell lock together when in the closed configuration via a clamshell spring lock snapping into place in a spring lock port.

6. The supplemental support for an infant carrier handle of claim 2, wherein the bottom clamshell and top clamshell lock together when in the closed configuration via a clamshell spring lock snapping into place in a spring lock port.

7. The supplemental support for an infant carrier handle of claim 3, wherein the bottom clamshell and top clamshell lock together when in the closed configuration via a clamshell spring lock snapping into place in a spring lock port.

8. The supplemental support for an infant carrier handle of claim 4, wherein the bottom clamshell and top clamshell lock together when in the closed configuration via a clamshell spring lock snapping into place in a spring lock port.

9. The supplemental support for an infant carrier handle of claim 1, further comprising:

an upper arm support attached to the top clamshell support structure proximal end; and the upper arm support having an upper arm cushion designed to contact an upper arm of the user during use.

10. The supplemental support for an infant carrier handle of claim 8, further comprising:

an upper arm support attached to the top clamshell support structure proximal end; and the upper arm support having an upper arm cushion designed to contact an upper arm of the user during use.

11. The supplemental support for an infant carrier handle of claim 1, further comprising:

a safety lanyard assembly having a safety lanyard that extends from a first end of the safety lanyard to a second end of the safety lanyard;

the first end of the safety lanyard attaching to the top clamshell at a lanyard mount; and the second end of the safety lanyard is placed over the handle of the infant carrier and locked in place so that if the retention strap fails the safety lanyard functions as a backup means of securing the supplemental support on the infant carrier handle.

12. The supplemental support for an infant carrier handle of claim 2, further comprising:

a safety lanyard assembly having a safety lanyard that extends from a first end of the safety lanyard to a second end of the safety lanyard;

the first end of the safety lanyard attaching to the top clamshell at a lanyard mount; and the second end of the safety lanyard is placed over the handle of the infant carrier and locked in place so that if the retention strap fails the safety lanyard functions as a backup means of securing the supplemental support on the infant carrier handle.

13. The supplemental support for an infant carrier handle of claim 3, further comprising:

a safety lanyard assembly having a safety lanyard that extends from a first end of the safety lanyard to a second end of the safety lanyard;

the first end of the safety lanyard attaching to the top clamshell at a lanyard mount; and the second end of the safety lanyard is placed over the handle of the infant carrier and locked in place so that if the retention strap fails the safety lanyard functions as a backup means of securing the supplemental support on the infant carrier handle.

14. The supplemental support for an infant carrier handle of claim 4, further comprising:

a safety lanyard assembly having a safety lanyard that extends from a first end of the safety lanyard to a second end of the safety lanyard;

the first end of the safety lanyard attaching to the top clamshell at a lanyard mount; and the second end of the safety lanyard is placed over the handle of the infant carrier and locked in place so that if the retention strap fails the safety lanyard functions as a backup means of securing the supplemental support on the infant carrier handle.

15. The supplemental support for an infant carrier handle of claim 5, further comprising:

a safety lanyard assembly having a safety lanyard that extends from a first end of the safety lanyard to a second end of the safety lanyard;

the first end of the safety lanyard attaching to the top clamshell at a lanyard mount; and the second end of the safety lanyard is placed over the handle of the infant carrier and locked in place so that if the retention strap fails the safety lanyard functions as a backup means of securing the supplemental support on the infant carrier handle.

16. The supplemental support for an infant carrier handle of claim 6, further comprising:

a safety lanyard assembly having a safety lanyard that extends from a first end of the safety lanyard to a second end of the safety lanyard;

the first end of the safety lanyard attaching to the top clamshell at a lanyard mount; and the second end of the safety lanyard is placed over the handle of the infant carrier and locked in place so that if the retention strap fails the safety lanyard functions as a backup means of securing the supplemental support on the infant carrier handle.

17. The supplemental support for an infant carrier handle of claim 7, further comprising:

a safety lanyard assembly having a safety lanyard that extends from a first end of the safety lanyard to a second end of the safety lanyard;

the first end of the safety lanyard attaching to the top clamshell at a lanyard mount; and the second end of the safety lanyard is placed over the handle of the infant carrier and locked in place so that if the retention strap fails the safety lanyard functions as a backup means of securing the supplemental support on the infant carrier handle.

18. The supplemental support for an infant carrier handle of claim 8, further comprising:

a safety lanyard assembly having a safety lanyard that extends from a first end of the safety lanyard to a second end of the safety lanyard;

the first end of the safety lanyard attaching to the top clamshell at a lanyard mount; and the second end of the safety lanyard is placed over the handle of the infant carrier and locked in place so that if the retention strap fails the safety lanyard functions as a backup means of securing the supplemental support on the infant carrier handle.

19. The supplemental support for an infant carrier handle of claim 9, further comprising:

a safety lanyard assembly having a safety lanyard that extends from a first end of the safety lanyard to a second end of the safety lanyard;

the first end of the safety lanyard attaching to the top clamshell at a lanyard mount; and the second end of the safety lanyard is placed over the handle of the infant carrier and locked in place so that if the retention strap fails the safety lanyard functions as a backup means of securing the supplemental support on the infant carrier handle.

20. The supplemental support for an infant carrier handle of claim 10, further comprising:

a safety lanyard assembly having a safety lanyard that extends from a first end of the safety lanyard to a second end of the safety lanyard;

the first end of the safety lanyard attaching to the top clamshell at a lanyard mount; and the second end of the safety lanyard is placed over the handle of the infant carrier and locked in place so that if the retention strap fails the safety lanyard functions as a backup means of securing the supplemental support on the infant carrier handle.

* * * * *